US006952906B2

(12) United States Patent
Nelson

(10) Patent No.: US 6,952,906 B2
(45) Date of Patent: Oct. 11, 2005

(54) PACKAGED FURNITURE ASSEMBLY AND METHOD THEREOF FOR COMPRESSIBLE FURNITURE

(75) Inventor: Shawn Nelson, Salt Lake City, UT (US)

(73) Assignee: Lovesac Corporation, Salt Lake City, UT (US)

( * ) Notice: Subject to any disclaimer, the term of this patent is extended or adjusted under 35 U.S.C. 154(b) by 0 days.

(21) Appl. No.: 10/662,962

(22) Filed: Sep. 15, 2003

(65) Prior Publication Data

US 2004/0107675 A1 Jun. 10, 2004

Related U.S. Application Data

(62) Division of application No. 10/074,597, filed on Feb. 11, 2002.

(51) Int. Cl.[7] ..... B65B 31/04

(52) U.S. Cl. ..... 53/434; 53/432; 53/436

(58) Field of Search ..... 297/452.41, 452.48, 297/452.17, 284.1, 284.6; 53/432, 433, 434, 436; 5/655.4; 190/107

(56) References Cited

U.S. PATENT DOCUMENTS

| | | | | |
|---|---|---|---|---|
| D153,191 | S | 3/1949 | Walters | D6/335 |
| 2,764,859 | A * | 10/1956 | Hanselmann | 53/434 |
| 3,307,319 | A * | 3/1967 | Christensen et al. | 53/434 |
| 3,458,966 | A * | 8/1969 | Hullhorst et al. | 53/434 |

(Continued)

FOREIGN PATENT DOCUMENTS

| | | | |
|---|---|---|---|
| EP | 075760 A1 | 12/1995 | B65B/25/20 |
| EP | 0705760 B1 | 12/1995 | B65B/25/20 |
| EP | 0705760 A1 | 12/1995 | B65B/25/20 |
| GB | 2214071 | 8/1989 | |

OTHER PUBLICATIONS 2 pages from www.spacebag.com printed on Jan. 30, 2002.
2 pages from www.spacebag.com/comm.htm printed on Jan. 30, 2002.
3 pages from www.bio.umass.edu/microscopy/tecnai/tem/vacintro.htm printed on Feb. 4, 2002.
2 pages from www.cretel.com/model620.htm printed on Feb. 4, 2002.

(Continued)

*Primary Examiner*—Louis Huynh
(74) *Attorney, Agent, or Firm*—Workman Nydegger

(57) ABSTRACT

The present invention provides a chair having a removable outer cover. The chair has an air permeable bladder which houses compressible filler material. The compressible filler material allows the chair to be selectively compressed between various compressed states. A method for packaging the chair is provided which significantly reduces the weight and size of the chair. The method includes placing the chair in a vacuum chamber and suctioning air from the chair. The vacuum chamber may be partially open or closed during storage.

18 Claims, 5 Drawing Sheets

U.S. PATENT DOCUMENTS

| | | | | | |
|---|---|---|---|---|---|
| 3,899,210 | A | * | 8/1975 | Samhammer et al. | 297/452.17 |
| 3,935,690 | A | | 2/1976 | Lea | 53/24 |
| 3,965,506 | A | * | 6/1976 | Marks | 297/452.17 |
| 3,968,620 | A | * | 7/1976 | Keltner | 53/434 |
| 3,992,733 | A | | 11/1976 | Racine | 5/652 |
| 4,011,611 | A | | 3/1977 | Lederman | 5/655.4 |
| 4,016,707 | A | | 4/1977 | Puchosic | 53/24 |
| 4,027,888 | A | | 6/1977 | Wilcox | 297/284.1 |
| 4,184,237 | A | | 1/1980 | Blankenship | 29/451 |
| 4,327,046 | A | | 4/1982 | Davis et al. | 264/102 |
| 4,418,514 | A | * | 12/1983 | Spann | 53/436 |
| 4,841,713 | A | * | 6/1989 | Beier | 53/434 |
| 4,928,337 | A | | 5/1990 | Chauncey | 5/465 |
| 5,106,884 | A | | 4/1992 | Turner et al. | 521/123 |
| 5,228,158 | A | | 7/1993 | Park | 5/636 |
| 5,265,295 | A | | 11/1993 | Sturgis | 5/655.9 |
| D355,077 | S | | 2/1995 | Tegner | 5/653 |
| 5,476,184 | A | * | 12/1995 | Hill | 190/107 |
| 5,566,953 | A | | 10/1996 | Arriola et al. | 273/115 |
| 5,620,069 | A | * | 4/1997 | Hurwitz | 190/107 |
| D384,211 | S | | 9/1997 | Wied et al. | D6/349 |
| 5,733,012 | A | | 3/1998 | Jones | 297/452.17 |
| 5,813,932 | A | | 9/1998 | Grafton | 473/594 |
| 5,878,551 | A | | 3/1999 | Curley | 53/434 |
| 6,053,829 | A | | 4/2000 | Conley | 473/594 |
| 6,141,807 | A | | 11/2000 | Tapper | 5/563 |
| 6,279,184 | B1 | | 8/2001 | George, II | 5/652 |
| 6,334,227 | B1 | | 1/2002 | Larger | 5/653 |
| 6,363,557 | B2 | | 4/2002 | Chou | 5/645 |
| 6,532,613 | B2 | * | 3/2003 | Berry, IV | 5/655.4 |
| 6,725,482 | B2 | | 4/2004 | George, II | 5/652 |
| 6,732,391 | B2 | | 5/2004 | George, II | 5/652 |
| 2003/0066268 | A1 | | 4/2003 | George, II | 53/432 |

OTHER PUBLICATIONS 1 page from www.lovesac.com printed on Feb. 11, 2002.
1 page from www.lovesac.com/products.html printed on Feb. 11, 2002.
1 page from www.lovesac.com /construction.html printed on Feb. 11, 2002.
1 page from www.lovesac.com/photos.html printed on Feb. 11, 2002.
1 page from www.lovesac.com/photo_2.html printed on Feb. 11, 2002.
1 page from www.lovesac.com/photo_3.html printed on Feb. 11, 2002.
2 pages from www.lovesac.com/lovesac.html printed on Feb. 11, 2002.
1 page from www.lovesac.com/orders.html printed on Feb. 11, 2002.
4 pages from https://secure.ntbz.com/nbizz/etceteras/esorder.html printed on Feb. 11, 2002.

* cited by examiner

PACKAGED FURNITURE ASSEMBLY AND METHOD THEREOF FOR COMPRESSIBLE FURNITURE

CONTINUITY

This patent application is a divisional of U.S. patent application Ser. No. 10/074,597, filed Feb. 11, 2002 entitled PACKAGED FURNITURE ASSEMBLY AND METHOD THEREOF FOR COMPRESSIBLE FURNITURE to inventor Shawn Nelson, which is incorporated herein by reference in its entirety.

BACKGROUND OF THE INVENTION

1. The Field of the Invention

The present invention relates to the field of furniture. Particularly, the present invention relates to the packaging of furniture for storage and shipping. More particularly, the present invention relates to a method for packaging compressible furniture.

2. The Relevant Technology

A variety of types of furniture have been developed over the years to provide comfort and decoration. Consumers appreciate furniture which can withstand a high level of use without having to be quickly replaced. Thus, it is desirable to make furniture that is durable and high quality.

Once purchased, consumers expect furniture to be easily assembled. Once assembled, consumers appreciate furniture which can be readily cleaned. Most upholstered furniture has the upholstery nailed or stapled to the furniture, requiring new upholstery if the furniture should become soiled or stained. It would thus be an advantage to have furniture which is easily assembled and disassembled for cleaning purposes.

One aspect that makes furniture cost-prohibitive is shipping and packaging. For example, a large piece of furniture requires a large amount of space during shipping. Usually, large pieces of furniture comprise wood or metal pieces and/or fittings. These pieces add additional weight which increases the cost of shipping. Naturally, air also contributes to the weight of furniture. It would thus be an advancement in the art to decrease the volume and weight of furniture during shipping.

Another aspect that makes furniture cost-prohibitive is the difficulty in stacking furniture. When large pieces of furniture are stacked, damage frequently occurs to the furniture on the bottom of the stack. Even when furniture is disassembled and boxed in order to facilitate stacking, often there is still much wasted space which increases the cost of shipping. It would thus be an advantage to be able to have furniture which is easily stackable.

Another problem that occurs during shipping is that cushions or cushioned areas on furniture are often inadequately protected such that they are easily torn or punctured.

For those consumers who cannot afford many pieces of furniture, it is also desirable to have furniture which can provide multiple functions. For example, a futon bed serves the function of both a bed and a couch. However, futon beds are bulky, and thus subject to the cost factors described above. In addition, futon mattresses are often thin and uncomfortable both as a couch and as a bed. Further, futon beds are difficult to transport to and from different locations. Thus, it would be an advantage to have a piece of furniture which can conveniently transported.

SUMMARY AND OBJECTS OF THE INVENTION

A need therefore exists for a quality, low maintenance, and versatile piece of furniture and a method for packaging the piece of furniture that reduces shipping costs, while eliminating the above-described problems and disadvantages.

Thus, it is an object of the invention to provide a piece of furniture which is durable, versatile and aesthetically pleasing.

It is another object of the invention to provide a simple design for a piece of furniture which reduces costs of manufacturing.

Another object of the invention is to provide a simple design for a piece of furniture which reduces the costs of shipping.

It is yet another object of the invention to provide a method for packaging a piece of furniture which reduces the weight and volume of the piece of furniture.

Another object of the invention is to provide a method for packaging a piece of furniture which allows the furniture to be conveniently stacked and/or stored.

These and other objects of the invention will be apparent from the foregoing description. Accordingly, the present invention provides a furniture assembly which comprises a chair having a removable outer cover. Both the chair and outer cover may be generally spherical, generally cubical, or a variety of different shapes. The chair has an air permeable bladder housing compressible filler material which allows the chair to be selectively compressed between various compressed states. A method for packaging the chair is provided which significantly reduces the weight and size of the chair.

The method includes placing the chair in a vacuum chamber and connecting the vacuum chamber to a vacuum source in order to suction out the air from inside the chair. The chair and accompanying vacuum chamber are then placed inside a storage container. The vacuum chamber can be closed, partially open, or completely open while in the storage container. Leaving the chamber partially open allows some air to enter the vacuum chamber. This assists the chair to expand back to its original size and shape significantly faster upon removal from the vacuum chamber than it would with the vacuum chamber completely closed. However, in another embodiment, the vacuum chamber is completely closed so that the chair does not expand past the walls of a box while being shipped and/or transported. Finally, the storage container may be partially or completely closed.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

The present invention is directed toward an article of furniture which is versatile, comfortable, and durable. While it will be appreciated that the article of furniture may have many uses, for purposes of this discussion, the following description will refer to the article of furniture as a chair.

Figure 1:
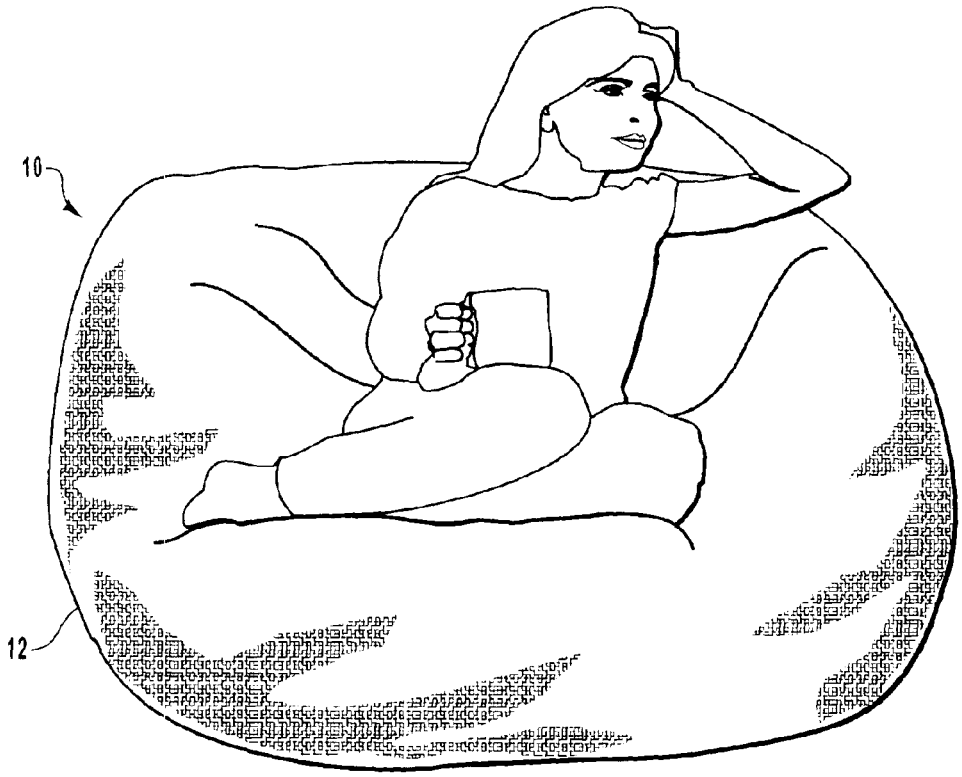
FIG. 1 illustrates a furniture assembly according to the present invention having a user resting comfortably thereon.

FIG. 1 shows a furniture assembly 10 according to the present invention. FIG. 1 depicts a large furniture assembly 10 with a person resting comfortably thereon. Furniture assembly 10 may range in size from large on which two adult sized people may comfortably rest, to small on which a small child may lie. It will be appreciated that furniture assembly 10 will conform to the shape of the person resting thereon to form a chair-like structure.

While FIG. 1 shows furniture assembly 10 being used in a chair-like function, furniture assembly 10 may have a variety of uses. Furniture assembly 10 may be flattened to provide a bed-like surface upon which to lie. A smaller furniture assembly 10 may function as an ottoman. Alternatively, furniture assembly 10 may function as a toy for children to jump or land upon during play. Further, furniture assembly 10 may be formed slightly elongated in shape so that a household pet, or even a small infant, may sleep comfortably thereon. Thus, it will be appreciated that furniture assembly 10 is extremely comfortable and versatile for a variety of uses.

Figure 13:
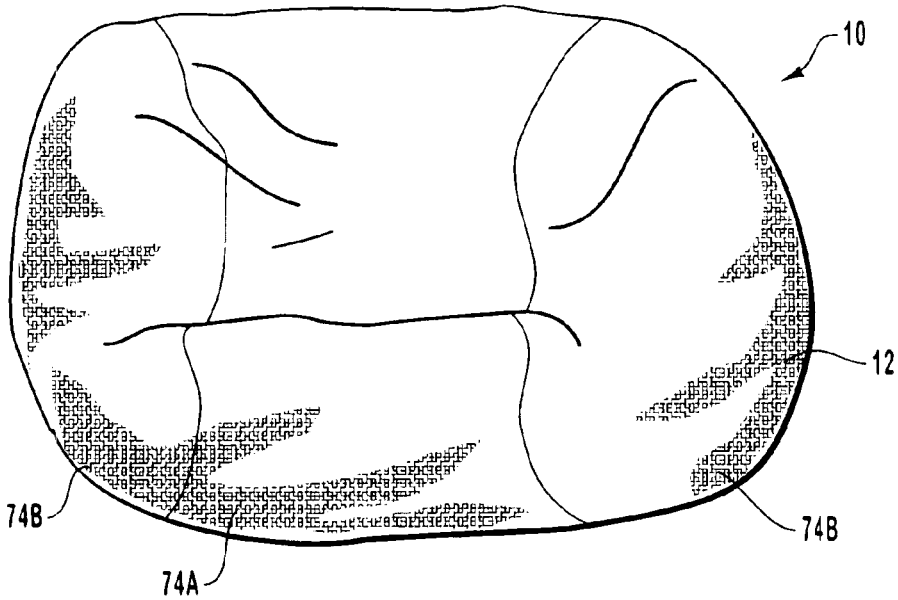
FIG. 13 illustrates a furniture assembly in accordance with the present invention.

Furniture assembly 10 may be constructed in a variety of shapes. As shown in FIG. 13, furniture assembly 10 is generally spherical in shape. However, it will be appreciated that furniture assembly may have a generally cubical or cylindrical shape, or a variety of other shapes. Furthermore, furniture assembly 10 is durable and is constructed from an efficient design which reduces the costs of manufacturing and packaging, the details of which will be described herein in further detail.

Figure 12:
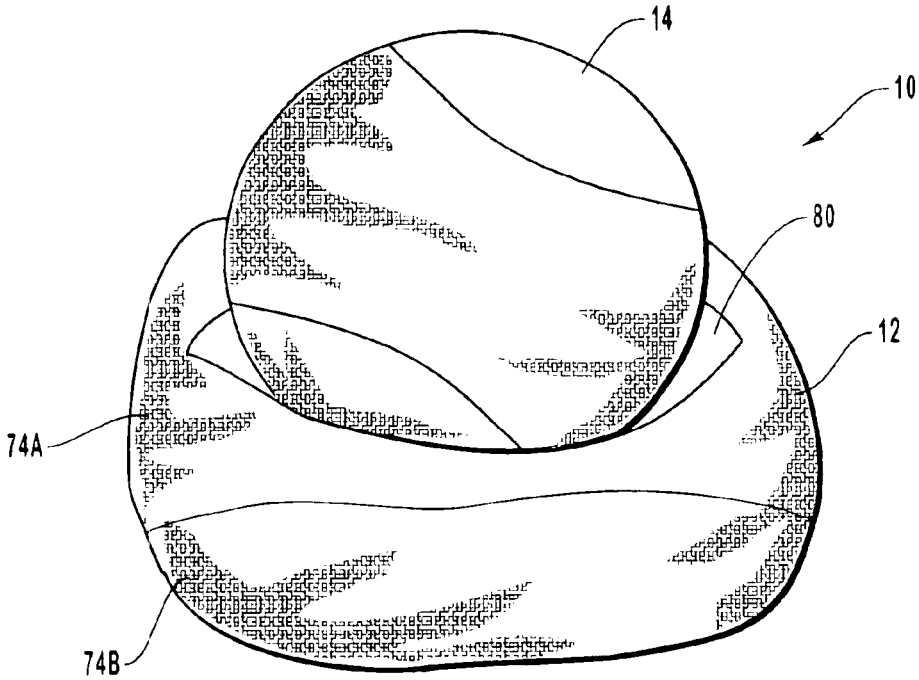
FIG. 12 illustrates the chair being placed in an outer cover.

Referring for a moment to FIG. 12, furniture assembly 10 comprises a chair 14 having a removable cover 12. As shown best in FIG. 4, chair 14 comprises an air permeable bladder 15 which houses filler material 24 disposed therein. While it is preferred to employ a protective cover 12 over bladder 15, another embodiment of a "furniture assembly" as discussed herein comprises a bladder 15 having a filler material 24 therein. An example of air permeable bladder 15 is shown in more detail in FIGS. 2 through 4.

Figure 2:
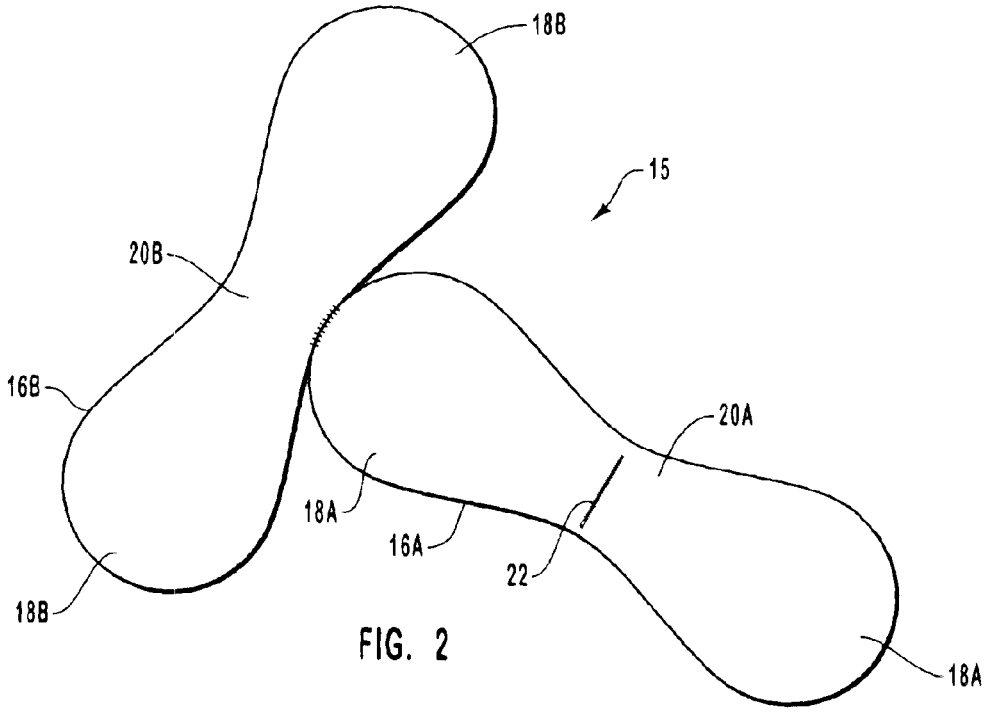
FIG. 2 illustrates the manufacture of an air permeable bladder of a chair of the present invention.
Figure 3:
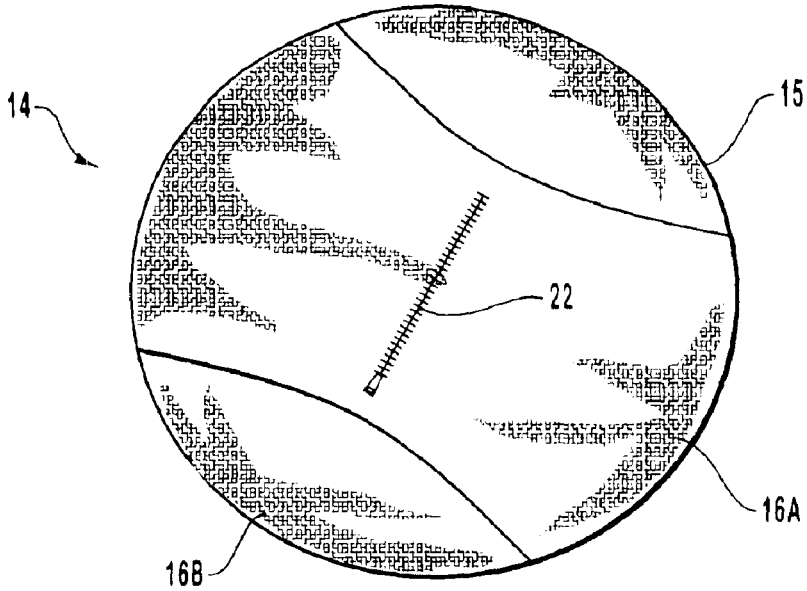
FIG. 3 illustrates the air permeable bladder of the chair.

FIG. 2 depicts one embodiment of the manufacture of air permeable bladder 15. Air permeable bladder 15 comprises two portions 16A, 16B (comprising, e.g., a fabric material) which have generally hour-glass shapes. However, it will be appreciated that a variety of shapes may be profitably employed. Portions 16A, 16B have end regions 18A, 18B and intermediate regions 20A, 20B. The end region 18A of one portion 16A is placed against the intermediate region 20B of another portion 16B. The edges of portions 16A and 16B are sewn together so that, as shown in FIG. 3, chair 14 forms a generally spherical structure.

One portion, e.g., 16A, has an opening 22 extending cross-wise across intermediate region, e.g., 20A. Opening 22 may be formed before portions 16A and 16B are sewn together. Opening 22 can be selectively opened and closed and thus comprises a structure which facilitates such opening and closing such as, but not limited to, a zipper, lacing, Velcro, or other connecting structure.

Preferably, air permeable bladder 15 is comprised of a flaccid, air-permeable, material, such as a fabric or mesh material. For example, air permeable bladder 15 may comprise a fabric material, such as cotton, polyester, woven or stitched materials, or various other fabric materials. In one embodiment, air permeable bladder 15 is constructed of a flaccid fabric which is a 7 ounce (oz.) 65% polyester 35% cotton twill with an untreated finish. Bladder 15 may also comprise another flaccid, air permeable material, for example.

As will be appreciated by one skilled in the art in light of this disclosure, bladder 15 may be constructed employing a variety of different methods and may comprise a variety of different air permeable, flaccid materials that allow it to receive a filler therein and comfortably conform to the shape of a user's body.

Figure 4:
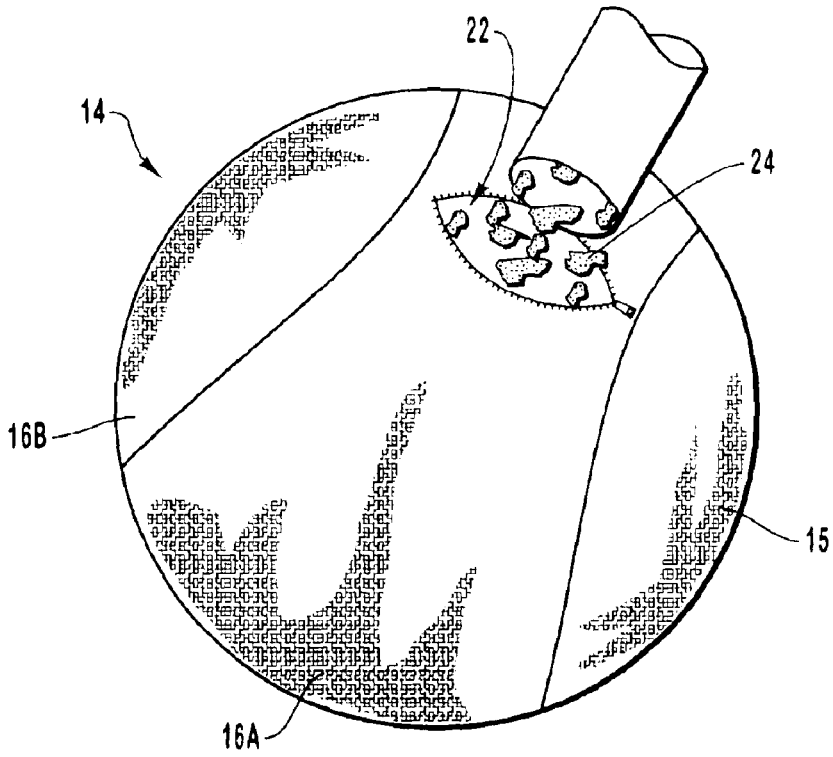
FIG. 4 illustrates the air permeable bladder of the chair having filler material placed therein.

As depicted in FIG. 4, air permeable bladder 15 is filled with a filler material 24. Filler material 24 is preferably a compressible material which is resilient so that it selectively expands and contracts. Furthermore, filler material 24 should be deformable such that when the chair 14 is filled, the filler material 24 conforms to the contours of a body. Filler material 24 may be cut into small pieces (e.g., about 1 inch pieces) of material before being placed in air permeable bladder 15. Filler material 24 may comprise foam, Styrofoam, and the like, for example.

A memory foam material may be employed such that the chair conforms to a persons body when in use, but the foam refills with air when a person gets off the chair, enabling the chair to puff back up. For example, in one embodiment, the filler material is a polyurethane foam having a density in an uncompressed state of approximately 1.5 to approximately 1.8 $lb/ft^3$.

After chair 14 is filled with the filler material 24, opening 22 is closed. In one embodiment, chair 14 can range in size from 2 feet to 7 feet in diameter, for example. Assuming a generally spherical configuration, this results in a volume of approximately 4 cubic feet to approximately 180 cubic feet. Thus, in one embodiment, chair 14 can weigh from approximately 7 lbs to approximately 324 lbs. It will be appreciated that as the diameter of chair 14, increases, so can its weight, depending on the density of the filler material. A large chair can be cumbersome to transport not only due to its weight but also due to the floppiness of the chair.

As shown in FIG. 12, chair 14 is inserted into cover 12. Cover 12 is easily removable from chair 14. One reason for this is that cover 12 may be made from a variety of colors, patterns, and/or fabrics so that the purchaser may select from various outer covers for the chair. In addition, chair 14 can be packaged and/or sold separately from cover 12. This prevents cover 12 from becoming wrinkled during the packaging process. Further, chair 14 can be packaged such that the volume and weight of the chair 14 is decreased. Advantageously, when the volume of chair 14 is diminished, the weight of the chair also decreases, thus, reducing packaging and shipping costs of the chair. Furthermore, as the size of chair 14 decreases, chair 14 increases in firmness which facilitates carrying and stacking of chairs.

Figure 5:
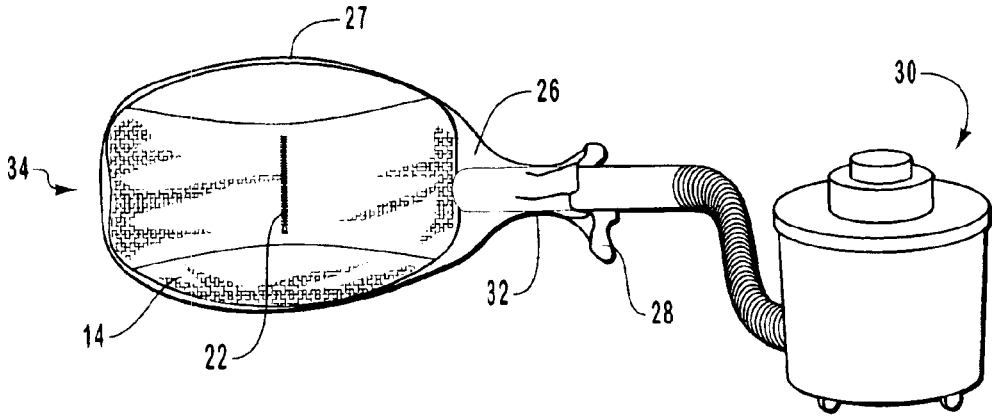
FIG. 5 illustrates the chair being compressed in a vacuum chamber by suctioning air therefrom.

Packaging of chair 14 will now be described. As shown in FIG. 5, chair 14 is placed inside a vacuum chamber 26 such that chamber 26 houses chair 14 therein. In its uncompressed state, chair 14 may have a very large volume. As such, it may be necessary for some of the air to be removed from chair 14 before it is placed inside vacuum chamber 26. One of the ways in which air can be initially removed is to roll or fold up chair 14 and/or place a persons weight on the chair 14 before placing it inside vacuum chamber 26.

Vacuum chamber 26 is generally an air impermeable container having a circular wall 27 and an opening 28. Opening 28 may be selectively opened or closed. Wall 27 of vacuum chamber 26 is comprised of an air-impermeable material. Preferably, chamber 26 comprises a flexible, air-impermeable material which will conform to the shape of chair 14, such as a plastic material, e.g., a plastic bag.

Once the chair is placed within the vacuum chamber, a vacuum source 30 is placed in communication with vacuum chamber 26 by being disposed through opening 28. A temporary substantially air-tight seal between vacuum source 30 and vacuum chamber 26 is formed, such as by pressing the vacuum chamber against the vacuum source, and the nozzle of the vacuum source is placed against the bladder 15. For example, opening 28 of vacuum chamber 26 can be manually held tight against the nozzle of the vacuum source 30 at neck 32 of vacuum chamber 26 to form a temporary air-tight seal.

Vacuum source 30 is operated so that the air in chair 14 is removed from bladder 15 and vacuum chamber 26. Vacuum chamber 26 at least substantially prevents additional air from entering chair 14 from the environment during the suctioning process. As the air is suctioned out of chair 14, the filler material 24 compresses and condenses together such that chair 14 diminishes in volume. As such, chair 14 changes from an uncompressed state 34 shown in FIG. 5 to a compressed state 36 depicted in FIG. 6. It will be appreciated that as chair 14 diminishes in volume, the weight of the chair also decreases. Thus, a chair 14 shown in FIG. 5 weighs more than the chair 14 shown in FIG. 6.

Figure 7:
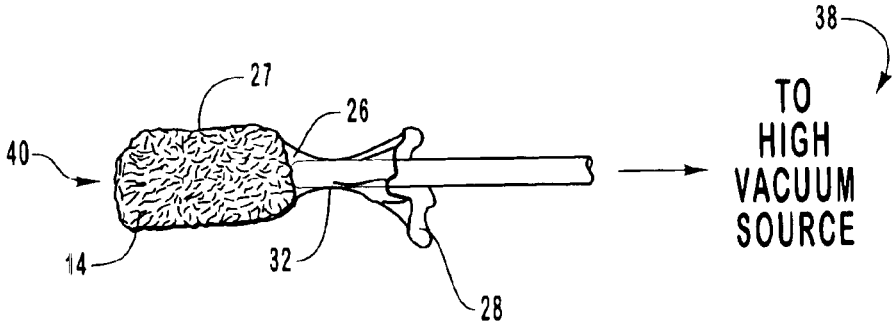
FIG. 7 illustrates the chair in a highly suctioned, compressed state.

In one embodiment, after compression of chair 14 has been performed by vacuum source 30, chair 14 may be further compressed by another higher-powered vacuum source 38. High-powered vacuum source 38 may be placed in communication with vacuum chamber 26 in much the same manner as discussed above. Opening 28 is temporarily sealed at neck 32 of chamber 26 and the high-power vacuum source 38 is operated. After operation, chair 14 is in a highly compressed state 40, which is depicted in FIG. 7.

In one embodiment, vacuum source 30 is a 10 gallon ShopVac® vacuum pump having a 6.25 hp motor. In another embodiment, vacuum source 30 is a 16 gallon Craftsman® pump having a 5.75 hp motor. Further, in one embodiment, high-powered vacuum source 38 is a vacuum pump with a negative pressure tank having a maximum negative pressure of 200 psi. The resting pressure in the tank is −22 inches Hg. The high-powered vacuum source 38 can operate from between −22 inches Hg to −10 inches Hg. The dual vacuum sources 30, 38 provide distinct advantages when packaging chair 14. The first vacuum source 30 provides a quick means for removing air from chair 14. The second high-powered vacuum source 38 provides a stronger suction action which, while slower, draws even more air out of chair 14 than would be obtainable by the first vacuum source.

Whether both vacuum sources 30, 38 are needed may depend on the size of chair 14 being packaged. For example, it may be preferred to use dual vacuum sources for a large chair which requires more vacuum power. Alternatively, in one embodiment, only vacuum source 30 or 38 is employed for a smaller chair. However, both sources may be employed if desired.

In a preferred embodiment, once chair 14 is in a compressed state 36, vacuum chamber 26 remains surrounding the chair and at least partially preventing the refilling of chair 14 with air. Usually, as air is suctioned out of vacuum chamber 26, wall 27 gathers together and puckers against the side of chair 14. Thus, the vacuum chamber 26 and chair 14 form a packaged furniture assembly 42 which may be placed in a storage container, thereby forming another furniture assembly including the chair, vacuum chamber, and storage container.

FIGS. 8 through 11 depict one embodiment wherein the storage container is a bag 44 or 54. The storage container may be air permeable or air impermeable depending upon a desired embodiment. When the storage container is air permeable, the storage container may be constructed of fabric material, for example. The storage container may also comprise another flaccid, air permeable material. In one embodiment, the storage container is made from 7 oz 100% cotton enameling duck with pure finish. For example, the storage container may comprise a duffle bag. When the storage container is made from an air impermeable material, it may be constructed from a material such as, but not limited to, plastic, or cardboard, for example.

Figure 8:
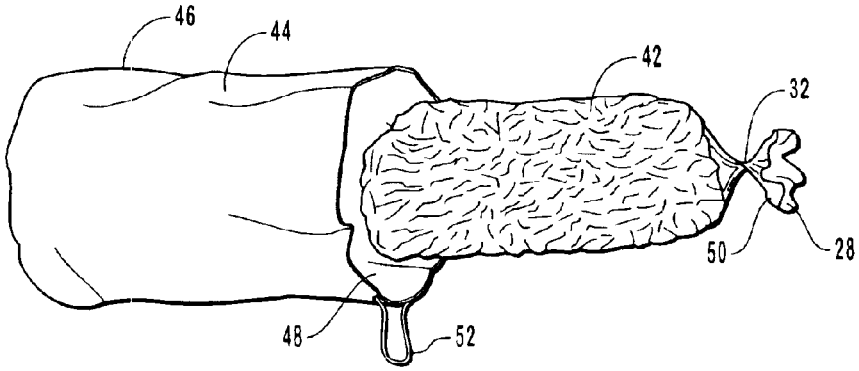
FIG. 8 illustrates an exploded view of (i) the compressed chair within the vacuum chamber; and (ii) the storage container.
Figure 9:
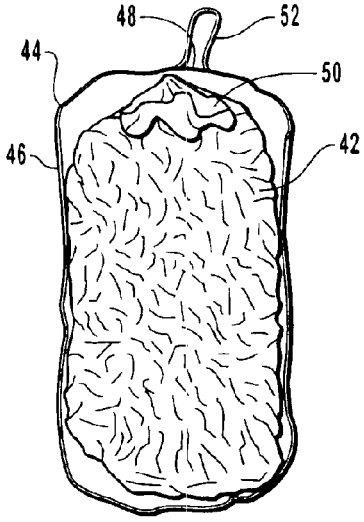
FIG. 9 illustrates the compressed chair within the vacuum chamber and container.

FIGS. 8 through 9 show an embodiment wherein bag 44 is constructed of a fabric material, such as a duffle bag. Bag 44 has a circular wall 46 and an opening 48. Opening 48 of bag 44 is selectively opened and closed by a drawstring 52. Preferably, bag 44 is slightly larger than packaged furniture assembly 42.

After packaged furniture assembly 42 is compressed to the desired level, opening 28 of vacuum chamber 26 is gathered at neck 32 (e.g., by twisting packaged furniture assembly 42 at neck 32) to minimize the amount of air that can enter into the packaged furniture assembly, leaving a plume 50. In one embodiment, packaged furniture assembly 42 is placed in bag 44 and assembly 42 is left partially open to allow air to enter the packaged furniture assembly through neck 32. This facilities the refilling of air into chair 14 when chair 14 is removed from bag 44 and vacuum chamber 26.

In one embodiment, a partial opening is formed in assembly 42 by gathering neck portion 32 thereof together without forming an airtight seal, thereby forming a partial opening. This can occur, for example by twisting plume 50 (e.g., rotating plume 50 in about one to about six revolutions) with respect to neck 32 and loosely folding plume 50 against the remainder of assembly 42, as shown in FIG. 9. Such rotations may also occur by holding plume 50 and spinning the remainder of assembly 42 below plume 50 (e.g., causing about one to about six revolutions of the portion of assembly 42 located below plume 50, such as about two, three, four or five revolutions).

A partial opening can also be formed by merely pressing inwardly about neck 32, such that the neck portion 32 is gathered together. Optionally, a partial opening can be formed by folding such a gathered plume 50 over. In another embodiment, a partial opening can be formed by completely sealing assembly 42 in its compressed state in an air tight manner, then forming a small opening in vacuum chamber 26 which is not sufficiently large to allow chair 14 to entirely refill with air or to be removed from the chamber through the opening. As another option, a partial opening may occur by placing a tie, sleeve, or clamp about the neck 32 of the vacuum chamber, thereby gathering a portion of the chamber together, without sealing the vacuum chamber in an air tight manner. As another option, a partial opening may occur by placing an adhesive within the neck 32 of the vacuum chamber, thereby gathering the neck 32, without sealing the vacuum chamber in an air tight manner.

As air enters the packaged furniture assembly 42, chair 14 begins to refill with air somewhat until chair 14 expands against wall 46 of bag 44. Because bag 44 is constructed of air permeable material, e.g., fabric, bag 44 may be closed before chair 14 completely expands to fill the bag. One advantage of employing an air-permeable bag 44 such as a fabric bag (e.g. a duffle bag) is that the bag will let some air in, but only expand to a certain size, thereby maintaining the overall assembly in a convenient size for storage and shipping.

As discussed above, after packaged furniture assembly 42 is placed inside bag 44, air is still allowed inside vacuum chamber 26 through plume 50. Drawstring 52 may be used to selectively open or close opening 48 of bag 44. However, because bag 44 is air permeable and because opening 28 of vacuum chamber 26 is still left partially open, chair 14 may continue to expand. In one embodiment, bag 44 is constructed of a strong, slightly expandable fabric (e.g., cotton weave) which allows chair 14 to expand until it presses tightly against the sides of bag 44. In one embodiment, bag 44 is cylindrical in shape so that chair 14 refills to produces a firm, generally cylindrical shaped structure which is convenient for carrying, storing and/or shipping chair 14. For example, a 3 foot diameter chair 14 can be reduced to a cylindrical shaped structure having a 15 inch diameter and height of 30 inches. As will be appreciated, the cylindrical structure is much easier to carry than a large chair, or even a boxed structure.

The process of removing air from a bladder and forming the bladder to a desired shape can be assisted by applying a force against the bladder during suctioning, such as by placing the weight of a person on the bladder during the suctioning process (i.e., by leaning on the vacuum chamber).

Figure 6:
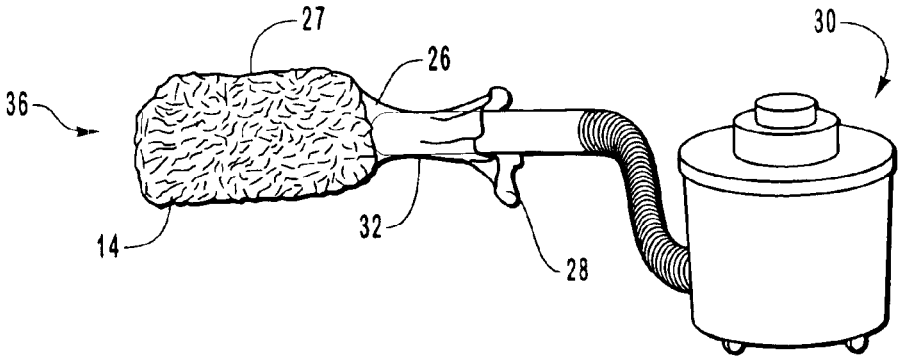
FIG. 6 illustrates the chair in a suctioned, highly compressed state.
Figure 10:
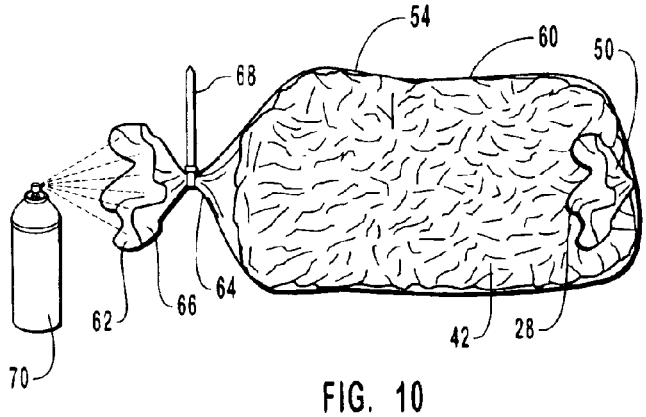
FIG. 10 illustrates an alternative embodiment for a furniture assembly.
Figure 11:
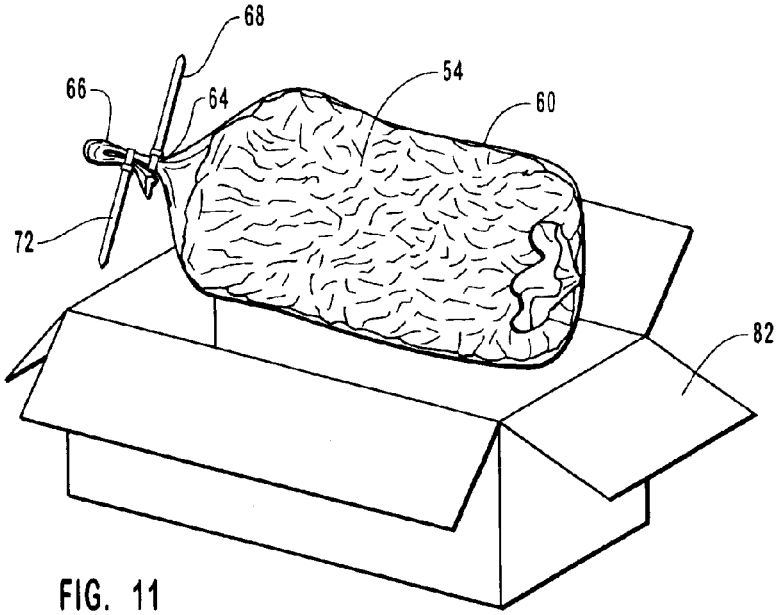
FIG. 11 illustrates another step of the alternative embodiment of FIG. 10.

FIGS. 10 through 11 depict another embodiment wherein a first storage container 54 is placed within a second storage container 82. In one embodiment, the first storage container 54 comprises another vacuum chamber constructed of an air impermeable material, e.g., plastic. Container 54 has a wall 60 and an opening 62. In this embodiment, all of the steps of producing the compressed packaged furniture assembly 42 as shown in FIGS. 5 through 7 remain the same. After chair 14 is compressed, forming assembly 42, the packaged furniture assembly 42 is placed inside storage container 54 (e.g., another plastic bag). The furniture assembly so formed is then placed in container 82.

Container has an opening 62. In FIG. 10 opening 28 of assembly 42 is positioned opposite opening 62 of container 54. This may be employed to provide an improved seal within chamber 26 and/or for convenience in placing assembly 42 within container 54. However, it will be appreciated that the positioning of packaged furniture assembly 42 within container 54 is not limited to this configuration.

While inside container 54, opening 28 of vacuum chamber 26 may be closed or partially open. When opening 28 is partially open, air is allowed to enter the vacuum chamber 26, allowing chair 14 to expand until it presses against wall 60 of container 54. For example, opening 28 may be left partially open by rotating plume 50 with respect to neck 32, and folding plume 50 onto the remainder of packaged furniture assembly 42, as shown in FIG. 10.

Alternatively, opening 28 may be sealed such as by rotating plume 50 and tying a knot therein or placing a tie thereat. When opening 28 is completely closed, the air in container 54 may be sucked out by a vacuum source so that the wall 60 of container 54 presses against packaged furniture assembly 42.

Opening 62 of container 54 may be closed by forming plume 66 as discussed above. As shown in FIG. 10, a tie 68 may then be disposed about neck 64 to prevent a significant amount of air from flowing back into container 54. Plume 66 can then be flared open and an adhesive 70 can be sprayed or otherwise applied on the inside of plume 66. Plume 66 is then closed and twisted so that adhesive 70 is secured inside the plume 66. Plume 66 is then bent over and the end of plume 66 is secured to neck 64 by a second tie 72, as shown in FIG. 11. Advantageously, the presence of multiple ties, adhesive, and a path which requires air to double back results in an at least substantially air-tight configuration so that the chances of chair 14 expanding inside container 54 are at least significantly reduced. This process may be employed without expensive vacuum sealing equipment. Optionally, such vacuum sealing equipment may be employed with a single or both vacuum chambers 42, 54. As shown in FIG. 11, the assembly comprising assembly 42 within container 54 can be stored and/or transported inside a box 82 without fear of bag 54 expanding and breaking the box. Optionally, the assembly comprising assembly 42 within container 54 may be stored and transported without box 82.

Advantageously, the foregoing embodiments reduce the volume and weight of chair 14 and facilitate storing and/or transporting the chair 14. The following table gives example calculations for approximate measurements taken from three sizes of chairs 14. First, the original volume of each chair in an uncompressed state is given in light of the chair's generally spherical shape. Next, the volume of the packaged furniture assembly 42 is calculated based on a generally rectangular cubical structure having a height, width and length. Finally, the volume of the packaged furniture assembly 42 when in a storage container is calculated based on the generally cylindrical shape of the packaged furniture assembly 42. In addition, the percentage volume of the final product is given. The volume percentage that is given represents that the chair is reduced to about X% of the original volume. The percentage by which the chair is reduced by can be easily calculated by calculating 100% less X%.

| | Small | Intermediate | Large |
|---|---|---|---|
| Approximate Measured circumference (see FIGS. 3–4) | 7 ft | 10 ft | 17 ft 3 in |
| Original volume (based on generally spherical configuration of FIGS. 3–4) | 5.79 $ft^3$ | 16.89 $ft^3$ | 86.68 $ft^3$ |
| Approximate Height, width, and length of highly condensed packaged furniture assembly (see FIG. 7) | 9 in × 8 in × 14 in | 10 in × 9 in × 26 in | 15 in × 14 in × 39 in |
| Highly condensed volume (based on generally | 0.58 $ft^3$ | 1.35 $ft^3$ | 4.74 $ft^3$ |

-continued

| | Small | Intermediate | Large |
|---|---|---|---|
| rectangular cubical configuration of FIG. 7) | | | |
| Reduced to X % of original volume | 10% | 8% | 5.5% |
| Approximate Circumference and height of generally cylindrical storage container with packaged furniture assembly having the opening of the packaged furniture assembly partially open (see FIG. 9) | 35 in × 18 in | 50 in × 35 in | 72 in × 42 in |
| Volume in generally cylindrical storage container of FIG. 9 | 1.02 $ft^3$ | 4.03 $ft^3$ | 10.03 $ft^3$ |
| Reduced to X % of original volume | 17.5% | 24% | 11.5% |

The foregoing process provides a significant reduction in volume of chair 14. As will be appreciated, the weight of the chair is reduced by the amount of air removed from the chair 14. It will be appreciated that the foregoing method for packaging chair 14 allows a significantly higher number of chairs 14 to be transported that would be possible if the chair 14 were simply packaged in, for example, a box, without applying the inventive steps above.

In the foregoing embodiments, as discussed the opening 28 of vacuum chamber 26 can either be left partially open so as to allow at least a minimal amount of air inside the vacuum chamber during storage or the opening can be sealed closed to shut off communication with the atmosphere. Both options have certain advantages which will now be discussed in additional detail.

For example, as shown in FIG. 11, sometimes the user will desire to package chair 14 in a box. Because compressed filler material 24 can expand when exposed to air, it is sometimes desirable to limit the amount of expansion of the chair. Because a typical cardboard box may not have the strength to withstand the expansion of the chair if the vacuum chamber 26 is left open, it may be necessary to limit the expansion that chair 14 may undergo during storage. For this reason, the opening 28 of vacuum chamber 26 and/or the opening 62 of container 54 may be closed before it is placed in the storage container. The storage container may also be sealed as discussed above.

However, when the storage container is a durable, flaccid, fabric bag, the bag can withstand the expansion pressures of the chair so that sealing the vacuum chamber 26 is not necessary. In fact, it is often advantageous to leave vacuum chamber 26 open to the atmosphere because it increases the rate of expansion of the filler material 24 when chair 14 is removed from vacuum chamber 26. When vacuum chamber 26 is left partially open, as depicted in FIG. 9 and the discussion relating thereto, chair 14 can expand to its original size within about 1 day. In contrast, when vacuum chamber 26 is sealed to the atmosphere, it can take up to 1 week for chair 14 to expand to its original size. Of course, fluffing actions (e.g., kicking, punching, tossing) chair 14 will accelerate the rate of expansion. As will be appreciated, leaving vacuum chamber 26 open to the atmosphere during storing and/or transportation significantly increases the eventual rate of expansion of chair 14, allowing the user to enjoy the uses of chair 14 more quickly after removing the storage container and vacuum chamber.

It will be appreciated that the foregoing embodiments for packaging chair 14 prevent chair 14 from expanding back to its original volume and weight during storage and/or transportation. Advantageously, this prevents chair 14 from expanding unexpectedly and causing a potentially hazardous situation when a number of chairs are stacked. Furthermore, when chair 14 is compressed and disposed within a storage container, the storage container protects air permeable bladder 15 from coming in contact with any objects that might rip or tear the material. It will be appreciated that the efficient design of chair 14 does not require wood, metal, or plastic framing or fittings of any kind. However, the present invention also contemplates within its scope chairs 14 which might include wood, metal or plastic framings or fittings.

When the user desires to set up chair 14, the chair is removed from the corresponding storage container (i.e., bag 44 or 54) and separated from packaged furniture assembly 42. Chair 14 is allowed to expand back to its normal size. The user may accelerate the rate of expansion by fluffing chair 14. FIG. 12 shows chair 14 being inserted into cover 12. As long as the cover 12 is made from air permeable material, the chair can be placed inside the outer cover either before or after expansion has occurred.

Also as shown in FIG. 8, the compressed assembly 42 may have a smaller diameter than the container 44 in which it is ultimately placed to allow convenient placement therein and may be allowed to partially refill within the container 44 such that the eventual complete filling with air is more readily achieved when the chair is removed from the container.

In one embodiment, the chair of the present invention is selectively suctioned down to about 1% to about 99% of the original volume. In a preferred embodiment, the chair is selectively suctioned down to about 4% to about 50% of the original volume, such as down to about 5% to about 25% of the original volume, e.g., down to about 5% to about 15% of the original volume.

In one embodiment, the chair is selectively suctioned, then allowed to refill with air until reaching about 6% to about 99% of the chair's original volume, preferably until reaching about 8% to about 50% of the chair's original volume, such as about 10% to about 25% of the chair's original volume.

The manufacture of cover 12 may be similar to that for air permeable bladder 15 discussed above, for example. As shown in FIG. 12, cover 12 comprises two material portions 74A, 74B which may have generally hour-glass shapes. Material portions 74A, 74B have end regions (not shown) and intermediate regions (not shown). The end region of one material portion is placed against the intermediate region of the other material portion similar to that shown in FIG. 2 for air permeable bladder 15. The edges of the material portion are sewn together so that, when filled, cover 12 forms a generally spherical structure. However, it will be appreciated that other shapes are contemplated within the scope of the present invention such as generally cubical, generally cylindrical, and other geometrical shapes.

One material portion has an opening 80 extending lengthwise across the material portion. In one embodiment, opening 80 is formed before the material portions are sewn together. Opening 80 can be selectively opened and closed and thus cover 12 comprises a structure which facilitates such opening and closing such as, but not limited to a zipper, lacing, Velcro, or other connecting structure. Cover 12 may comprises an air-permeable material. For example, cover 12 may comprise a fabric material, for example, or another flaccid material.

In one embodiment, cover 12 is constructed from 7 oz 65% polyester 35% cotton with crease resistant finish. Other air permable materials may be employed such as, but not limited to linen and nylon velvet. Advantageously, cover 12 can be made of different patterns and colors or may incorporate features such as logos or pockets.

Also, in another embodiment, such as when the cover comprises a vinyl or leather material, an air permeable portion or "patch" is located on the cover. This portion may be associated with a logo, for example. In one embodiment, this air permeable portion may comprise a suraline gabardine material that breathes well such that air can fill bladder 15 through the portion to thereby cause the filler material 24 to fill with air when a person gets off the chair. The air permeable portion may comprise a stretchable material, for example.

As shown in FIG. 12, chair 14 is inserted into opening 80 of cover 12. Opening 80 is closed and the user can then arrange furniture assembly 10, shown in FIGS. 1 and 14, into the configuration desired. It will be appreciated that even after packaging chair 14, the chair retains at least substantially all of its original compressibility, pliability, and resiliency that it originally had. As such, the user is provided a comfortable, durable piece of furniture which may be applied in a variety of uses.

In yet another embodiment of the present invention, toys, such as toy animals comprise an air permeable material with a filler material therein and are packaged according to one or more of the packaging methods disclosed herein, such as by suctioning the air from within the air permeable material, then placing the reduced sized toy animal in a container, such as a small duffle bag. Optionally, the reduced sized toy animal may be placed in a vacuum chamber, such as a plastic bag as discussed above, before being placed in the container (e.g., duffle bag). Also as discussed above, the reduced-sized toy animals may have a smaller diameter than the container in which it is ultimately placed to allow convenient placement therein and may be allowed to partially refill within the duffle bag such that the eventual complete filling with air is more readily achieved when the toy animal is removed from the duffle bag or other container.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A method for packaging a chair, the method comprising:

forming a furniture assembly comprising a chair disposed inside a vacuum chamber, wherein the vacuum chamber comprises an opening which is selectively sealed and unsealed, the chair having an air permeable bladder housing compressible filler material, the compressible filler material being selectively compressible;

placing the vacuum chamber in communication with a vacuum source;

selectively compressing the compressible filler material using the vacuum source; and placing the compressed furniture assembly in a storage container with the opening of the vacuum chamber unsealed, wherein the storage container comprises an air permeable material.

2. The method as recited in claim 1, further comprising connecting the vacuum chamber in communication with a high-powered vacuum source to selectively compress the compressible filler material to a highly compressed state.

3. The method as recited in claim 1, wherein selectively compressing the compressible filler material comprises compressing the chair down to about 4% to about 50% of its original volume.

4. The method as recited in claim 1, wherein selectively compressing the compressible filler material comprises compressing the chair down to about 5% to about 25% of its original volume.

5. The method as recited in claim 1, further comprising removing the packaged furniture assembly from the storage container and removing the chair from the vacuum chamber, wherein the chair refills to substantially the original volume after removal from the vacuum chamber.

6. A method for manufacturing and packaging a chair, the method comprising:

providing an air permeable bladder;

placing a filler material within the air permeable bladder to form a chair such that the chair is selectively compressed when air is removed from within the chair;

placing the chair into a vacuum chamber having an opening;

suctioning a substantial amount of air from the chair with a vacuum source via said opening to compress the chair; and placing the compressed chair in a storage container, wherein the storage container comprises a fabric material.

7. A method as recited in claim 6, further comprising allowing the chair to partially refill with air while in the storage container.

8. A method as recited in claim 6, wherein the storage container comprises a duffle bag.

9. A method as recited in claim 6, wherein the storage container comprises an air permeable, pliable, cotton bag.

10. A method for packaging a chair, the method comprising:

providing a chair comprising (i) an air permeable bladder and (ii) a filler material disposed within the air permeable bladder, the chair being selectively compressed when air is removed from within the chair;

placing the chair in a vacuum chamber;

removing a substantial amount of air from the chair;

allowing the chair to partially refill with air, wherein the vacuum chamber has a partial opening therein;

placing the chair and vacuum chamber in a storage container, wherein the storage container has an opening which is selectively opened and closed; and sealing the opening of the storage container, wherein sealing the opening of the storage container comprises:

closing the opening of the storage container so that a plume extends therefrom; and applying adhesive to the inside of the plume.

11. A method as recited in claim 10, wherein removing a substantial amount of air from the chair comprises suctioning the air from the chair using a vacuum source.

12. A method as recited in claim 11, wherein removing a substantial amount of air from the chair comprises using a first vacuum source and subsequently a second high-powered vacuum source.

13. A method as recited in claim 11, wherein the vacuum chamber is allowed to remain partially open after the chair is placed in the storage container.

14. A method as recited in claim 10, further comprising flaring the plume so that the inside of the plume is exposed and constricting the plume so that the adhesive remains on the inside of the plume.

15. A method as recited in claim 10, wherein removing a substantial amount of air from the chair comprises compressing the chair down to about 1% to about 99% of the original volume.

16. A method as recited in claim 10, wherein removing a substantial amount of air from the chair comprises compressing the chair down to about 4% to about 50% of the original volume.

17. A method as recited in claim 10, wherein a substantial amount of air is removed from the chair, then allowed to refill with air until reaching about 8% to about 50% of the chair's original volume.

18. A method as recited in claim 10, wherein a substantial amount of air is removed from the chair, then allowed to refill with air until reaching about 10% to about 25% of the chair's original volume.

* * * * *

UNITED STATES PATENT AND TRADEMARK OFFICE

CERTIFICATE OF CORRECTION

PATENT NO. : 6,952,906 B2
APPLICATION NO. : 10/662962
DATED : October 11, 2005
INVENTOR(S) : Nelson It is certified that error appears in the above-identified patent and that said Letters Patent is hereby corrected as shown below:

Column 7
Line 56, after "Container" insert --54--

Column 9
Line 25, after "transported" change "that" to --than--

Column 10
Line 63, change "comprises" to --comprise--

Signed and Sealed this

Thirtieth Day of January, 2007

JON W. DUDAS
*Director of the United States Patent and Trademark Office*